US008918933B2

(12) United States Patent
Holden et al.

(10) Patent No.: US 8,918,933 B2
(45) Date of Patent: Dec. 30, 2014

(54) MOBILE FEEDING AND CHANGING TABLE

(75) Inventors: Robert Andrew Holden, Simpsonville, SC (US); Sarah Holden Greene, Charlotte, NC (US)

(73) Assignee: Baby Squared, LLC, Charlotte, NC (US)

( * ) Notice: Subject to any disclaimer, the term of this patent is extended or adjusted under 35 U.S.C. 154(b) by 0 days.

(21) Appl. No.: 13/559,679

(22) Filed: Jul. 27, 2012

(65) Prior Publication Data

US 2013/0025064 A1 Jan. 31, 2013

Related U.S. Application Data

(60) Provisional application No. 61/512,059, filed on Jul. 27, 2011.

(51) Int. Cl.

| | |
|---|---|
| ***B68G 5/00*** | (2006.01) |
| ***A47C 21/06*** | (2006.01) |
| ***A47B 7/02*** | (2006.01) |
| ***A47D 15/00*** | (2006.01) |
| ***A47D 5/00*** | (2006.01) |
| ***A47D 13/08*** | (2006.01) |

(52) U.S. Cl.

CPC ..... *A47D 5/00* (2013.01); *A47D 15/008* (2013.01); *A47D 13/08* (2013.01); *Y10S 5/943* (2013.01)

USPC ..... 5/655; 5/81.1 HS; 5/603; 5/943

(58) Field of Classification Search

CPC ... A61G 2200/32; A61G 7/05; A47D 15/008; A47D 13/08; A61B 5/0555

USPC ..... 5/81.1 HS, 603, 600, 943, 655; 108/5–7, 108/9, 143

See application file for complete search history.

(56) References Cited

U.S. PATENT DOCUMENTS

| | | | | | |
|---|---|---|---|---|---|
| 307,962 | A | * | 11/1884 | Kossbiel | 108/5 |
| 409,153 | A | * | 8/1889 | Kintz | 108/7 |
| 612,373 | A | * | 10/1898 | Allison | 312/240 |
| 806,850 | A | * | 12/1905 | Sommar | 33/430 |
| 2,030,348 | A | * | 2/1936 | Barrett | 312/313 |
| 2,051,490 | A | * | 8/1936 | Lightfoot | 108/32 |
| 2,194,889 | A | * | 3/1940 | De Lisle | 108/5 |
| 2,560,679 | A | * | 7/1951 | Zalkind | 108/4 |

(Continued)

FOREIGN PATENT DOCUMENTS

| | | | | |
|---|---|---|---|---|
| DE | 4019682 | A1 * | 1/1991 | A47D 5/00 |

OTHER PUBLICATIONS

Bebe Bottle Sling, LLC; http://www.bebebottlesling.com/index.htm; 2 pages.

(Continued)

*Primary Examiner* — William Kelleher
*Assistant Examiner* — Eric Kurilla
(74) *Attorney, Agent, or Firm* — Additon, Higgins & Pendleton, P.A.

(57) ABSTRACT

The invention relates to a mobile feeding table providing varied inclination angles to facilitate the secured feeding of one or more infants and providing ease of use for a parent or caregiver. The invention provides a moveable base frame, a body support frame supporting an infant and providing a variably inclined surface, and a sliding drawer supporting the support frame that promotes ease of use for a parent or caregiver when, for example, in a seated position.

9 Claims, 3 Drawing Sheets

(56) References Cited

U.S. PATENT DOCUMENTS

| | | | | | |
|---|---|---|---|---|---|
| 2,611,363 | A | * | 9/1952 | Peters | 5/603 |
| 2,675,288 | A | * | 4/1954 | Usher | 312/194 |
| 2,752,614 | A | * | 7/1956 | Hayward | 5/93.1 |
| 2,851,700 | A | * | 9/1958 | Denison | 5/93.1 |
| 2,947,998 | A | * | 8/1960 | Murphy | 5/632 |
| 2,973,889 | A | * | 3/1961 | Phillips | 294/140 |
| 3,605,650 | A | * | 9/1971 | Hebel et al. | 108/9 |
| 3,643,604 | A | * | 2/1972 | Jones et al. | 108/5 |
| 4,628,553 | A | * | 12/1986 | Buttitta et al. | 5/603 |
| 4,644,594 | A | * | 2/1987 | Johnson | 5/81.1 HS |
| 4,819,282 | A | * | 4/1989 | McArthur et al. | 5/610 |
| 4,932,086 | A | * | 6/1990 | Bergkvist | 4/546 |
| 5,172,641 | A | * | 12/1992 | Auer | 108/5 |
| 5,290,058 | A | * | 3/1994 | Adams et al. | 280/651 |
| 5,345,880 | A | * | 9/1994 | Shamie | 108/63 |
| 5,360,258 | A | * | 11/1994 | Alivizatos | 297/440.11 |
| 5,439,008 | A | * | 8/1995 | Bowman | 128/875 |
| D375,419 | S | * | 11/1996 | Levine | D6/384 |
| 5,599,063 | A | | 2/1997 | Lister et al. | |
| 5,664,828 | A | | 9/1997 | Simon | |
| 5,790,999 | A | | 8/1998 | Clark | |
| D413,151 | S | * | 8/1999 | Breuil | D21/519 |
| 6,263,526 | B1 | * | 7/2001 | Tu | 5/109 |
| 6,898,811 | B2 | * | 5/2005 | Zucker et al. | 5/626 |
| 6,898,812 | B2 | * | 5/2005 | Smart | 5/655 |
| 6,907,625 | B2 | * | 6/2005 | Nomura | 5/81.1 HS |
| 6,954,951 | B2 | * | 10/2005 | Lieboff et al. | 5/603 |
| 7,412,737 | B2 | | 8/2008 | Hernadez | |
| 7,578,011 | B2 | * | 8/2009 | Johnson | 5/81.1 R |
| 7,681,266 | B2 | | 3/2010 | Gerlach | |
| 7,703,159 | B2 | | 4/2010 | Parrilla | |
| 7,716,764 | B2 | | 5/2010 | Joe et al. | |
| 2007/0033730 | A1 | * | 2/2007 | Bean | 4/619 |
| 2008/0029103 | A1 | * | 2/2008 | Regev et al. | 128/875 |
| 2011/0067181 | A1 | * | 3/2011 | Luzzi | 5/655 |

OTHER PUBLICATIONS

Twinsuk; Harmony Duo Twin Feeding Cushion; http://www.twinsuk.co.uk/products/101546/Harmony-Duo-Twins-Breastfeeding-Cushion; 3 pages.

Think Twins; Double Cuddle Twin Bottle Feeding Pillow; http://www.thinktwins.com.au/catalog839909/product_info.php?cPath=106_219&products; 3 pages.

YouTube; Double Cuddle Featured on ABC New Inventors; http://www.youtube.com/watch?v=5jpMY7vJDQ4; 2 pages.

* cited by examiner

MOBILE FEEDING AND CHANGING TABLE

CROSS-REFERENCE TO PRIORITY APPLICATION

This application claims the benefit of and priority to U.S. Provisional Patent Application Ser. No. 61/512,059, filed Jul. 27, 2011, in the U.S. Patent and Trademark Office. This application incorporates the earlier provisional application by reference in their entirety.

BACKGROUND OF THE INVENTION

The present invention relates to the field of feeding and changing tables for infants and, in particular, a mobile feeding table providing varied inclination angles to facilitate the secured feeding of one or more infants and providing ease of use for a parent or caregiver.

Various devices have been developed for supporting infants and small children during feeding times and diaper changing sessions. Known devices include infant sleepers having a base frame and a planar surface whose angle of inclination can be varied. Other devices include infant sleepers having a base frame and a support frame wherein the support frame includes an opening and a holder (e.g., mesh or straps) for supporting the child.

That said, known devices are limited for use on a flat surface (e.g., floor or table) and require that the parent extend their arms over the flat surface to reach the infant. These known devices often require that a parent sit on the floor in an uncomfortable position or lean over a table. Moreover, the known devices require that a parent collect and carry the known devices to and from various surfaces. Therefore, a need exists for an improved feeding and changing table that provides an adjustably inclined framework for holding the infant, a mobile framework for moving the table, and an adjustable drawer that permits a parent to pull the supported infant over their lap for easy access to the infant.

Advantageously, the present invention provides a drawer base frame having coasters or wheels for moving the base frame, a drawer connected to the drawer base frame via a slide mechanism which moves the drawer towards and away from the parent, and a body support frame for supporting the infant, wherein the inclination of the body support frame is adjustable and wherein the drawer base frame is weighted to avoid tipping when the drawer is extended from the drawer base frame. Moreover, the present invention is extremely suitable for twins or infants of similar size, thereby permitting one parent to feed more than one child at a time.

SUMMARY OF THE INVENTION

In one embodiment, the present invention embraces a mobile feeding and changing table having a drawer base frame, a plurality of legs attached to the drawer base frame, a drawer connected to the drawer base frame via a slide mechanism such that the drawer extends from and retracts into the drawer base frame, a body support frame for supporting a body of a child, and a support hinge for adjusting an angle between the plane in which the drawer slides and the plane passing through ends of the body support frame, thereby adjusting the inclination of the small child's body.

In another embodiment, the invention may include a weight or weighted frame members towards the bottom of the table to prevent the table from tipping when the drawer is extended from the table.

In yet another embodiment, the invention may include locking coasters or wheels to prevent the table from shifting once the table is located in a desired position.

During use, a parent or caregiver may roll the table to a desired position, for example, in front of a chair, lock the coasters or wheels, place the infant in the body restraint supported by the body support frame, sit in the chair, and then pull the drawer supporting the body support frame and child over their lap, and adjustably incline the infant at a desired position. A locking means is provided to maintain the desired inclination. The functionality and ease-of-use of the subject invention is novel as compared to known feeding and changing tables. It will be understood that the body support frame may include one or more body holders for supporting one or more infants.

BRIEF DESCRIPTION OF THE DRAWINGS

The foregoing and other objects and advantages of the invention and the manner in which the same are accomplished will become clearer based on the following detailed description taken in conjunction with the accompanying drawings in which.

DETAILED DESCRIPTION OF THE INVENTION

Figure 1:
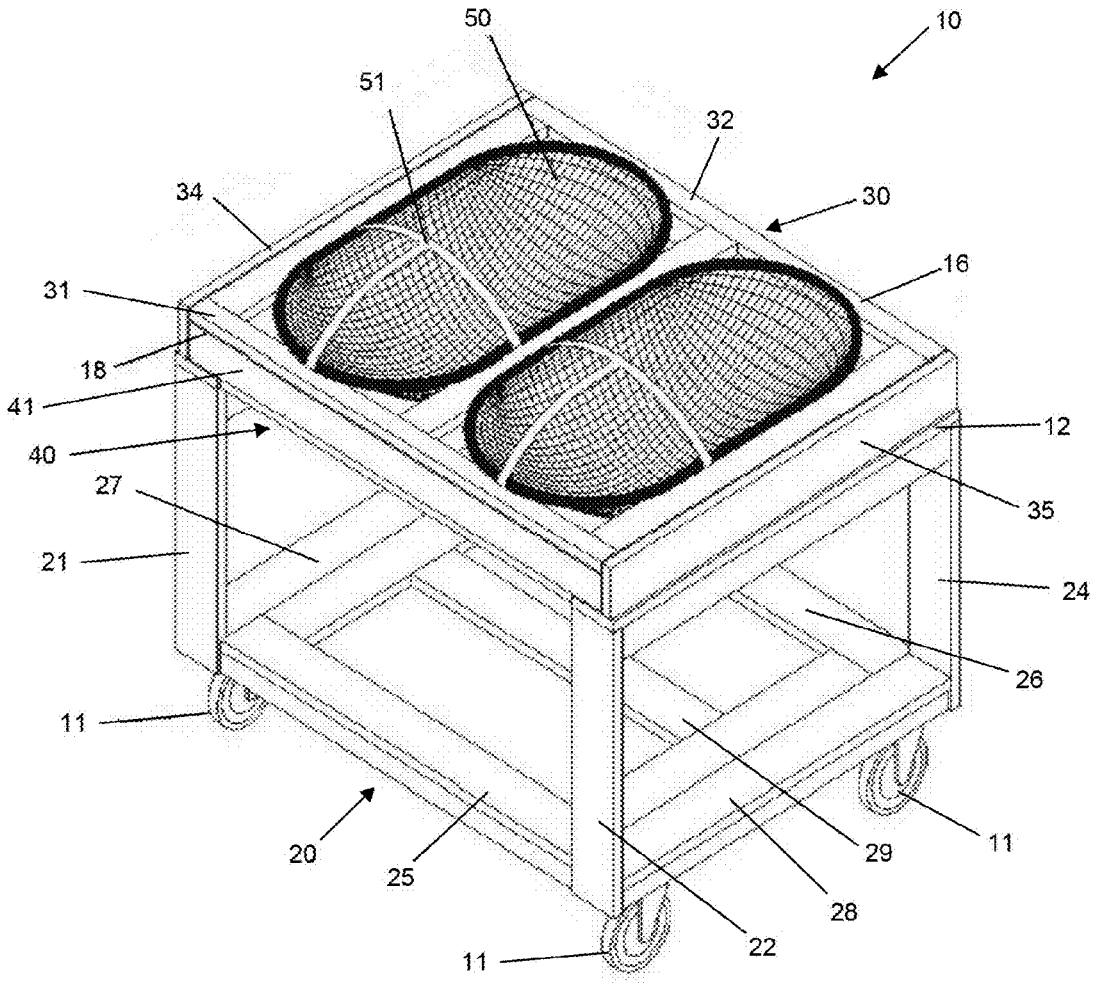
FIG. 1 is a perspective view of one embodiment of the subject invention depicting the body support frame and a parallel position relative to a floor surface.

The invention will now be described more fully hereinafter with reference to the accompanying drawings, in which multiple embodiments of the invention are shown. This invention may, however, be embodied in different forms and should not be construed as limited to the embodiments set forth herein. Rather, these embodiments are provided so that this disclosure will be thorough and complete and will fully convey the scope of the invention to those skilled in the art. Like numbers refer to like elements throughout. Further, like numbers with the prime notation refer to like or similar elements of the structure.

The present invention embraces a table 10 for supporting a small child's body having drawer base frame 12, a plurality of legs 21-24 fixedly attached to the drawer base frame 12, a drawer 40 connected to the drawer base frame 12 via a slide mechanism 37-38 (see FIGS. 2 and 3), a body support frame 30 adjustably connected to the drawer 40, and a support hinge 47-48 (see FIGS. 2 and 3) connected to the drawer 40 and body support frame 30 that permits adjustable inclination of the body support frame 30. As constructed, the present invention may support one or more infants.

In one embodiment the drawer base frame 12 is substantially rectangular. The legs 21-24 attached to the drawer base frame 12 extend downward (or perpendicularly) from the drawer base frame 12 to support and elevate the drawer base frame 12 above a floor surface. The legs 21-24 may include a foot-end left leg 21 fixedly attached to the foot-end left corner of the drawer base frame 12, a foot-end right leg 22 fixedly attached to the foot-end right corner of the drawer base frame 12, a head-end left leg 23 (not shown) fixedly attached to the head-end left corner of the drawer base frame 12, and a head-end right leg 24 fixedly attached to the head-end right corner of the drawer base frame 12.

A base 20 connects the lower portions of the legs 21-24. The base 20 is comprised of a foot-end base member 25 connecting the foot-end left leg 21 and foot-end right leg 22, a head-end base member 26 connecting the head-end left leg 23 (not shown) and the head-end right leg 24, a left side base member 27 connecting the foot-end left leg 21 and the head-end left leg 23, and a right side base member 28 connecting the foot-end right leg 22 and the head-end right leg 24. The base 20 may also include a base crossbar 29 connecting the foot-end base member 25 and head-end base member 26.

The drawer 40 is connected to the drawer base frame 12 via a slide mechanism 37 or 38 (see FIGS. 2 and 3) such that the drawer 40 slides in a plane substantially parallel to a plane formed by the drawer base frame 12. The body support frame 30 supports a body of a child and includes a foot-end 31 and a head-end 32. The support hinge 47-48 adjusts an angle between the plane in which the drawer 40 slides and the plane passing through the body support frame's foot-end 31 and head-end 32. Accordingly, the hinge adjusts the inclination of the child's body.

Figure 2:
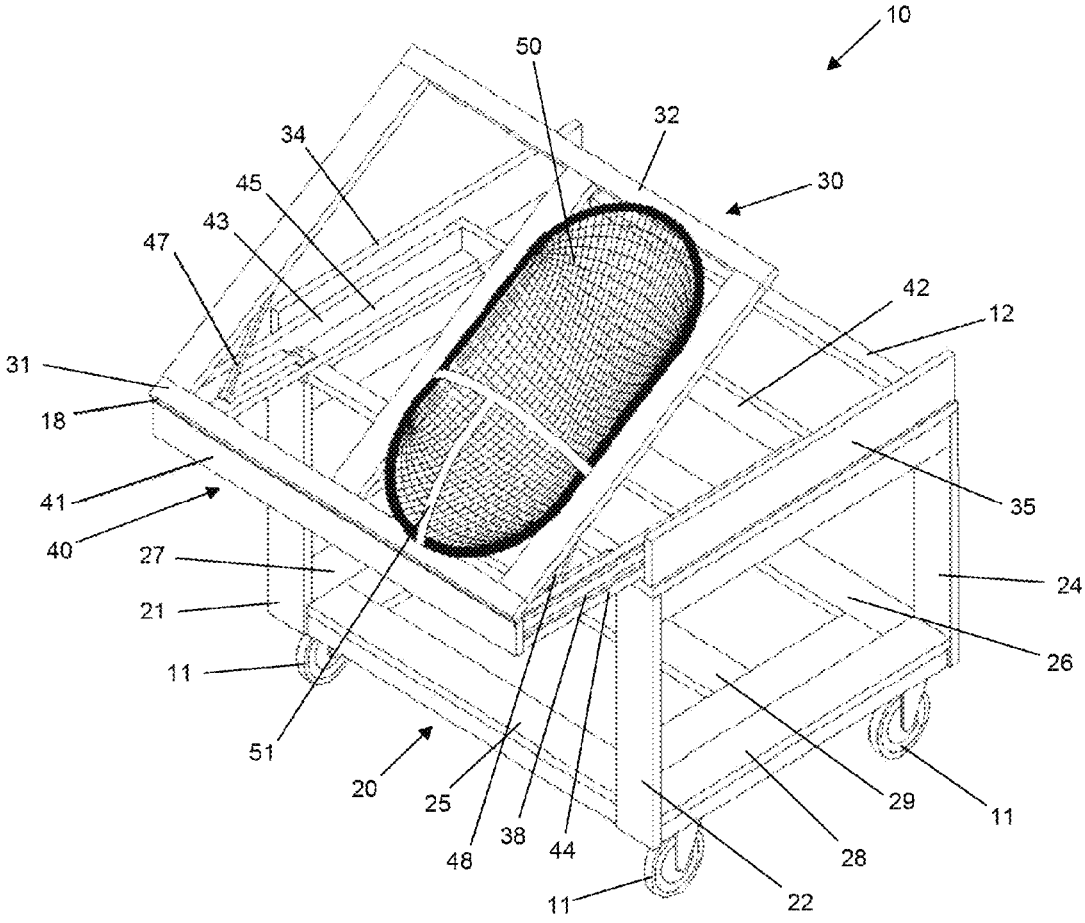
FIG. 2 is a perspective view of one embodiment of the subject invention depicting the body support frame at an inclined position and the drawer extended from the drawer base frame.
Figure 3:
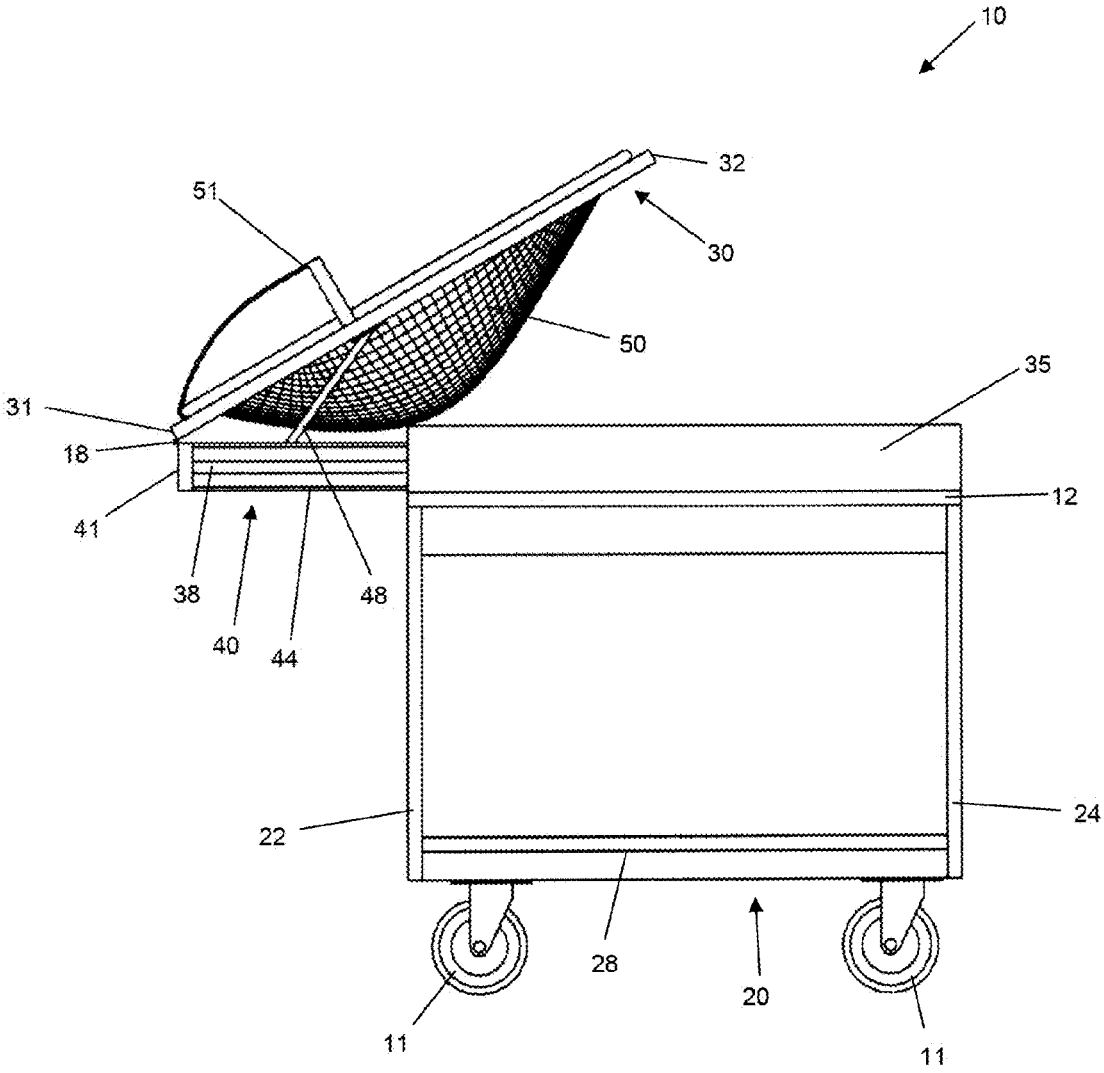
FIG. 3 is a perspective side view of one embodiment of the subject invention depicting the body support frame at an inclined position and the drawer extended from the drawer base frame.

The drawer 40 and body support frame 30 each include a foot-end edge connected by a continuous hinge 18 such that the body support frame 30 rotates about an axis defined by the continuous hinge 18 (see FIGS. 2 and 3).

The invention also includes left side and right side panels 34-35 that extend across the left and right side of the drawer base frame 12, respectively. The left side and right side panels 34-35 extend upward perpendicularly from the drawer base frame 12 and have vertical interior faces generally oriented toward the interior of the drawer base frame 12.

The invention also provides left and right slide mechanisms 37-38 (see FIGS. 2 and 3 for right slide mechanism 38; left slide mechanism 37 not shown). The left and right slide mechanisms 37-38 are positioned on the interior faces of the left and right side panels 34-35, respectively, and connect the drawer 40 to the drawer base frame 12.

The drawer 40 defines a drawer face 41 having an upper edge, a left end, and a right end. The drawer 40 further includes a rear drawer panel 42 (see FIG. 2) positioned substantially parallel to the drawer face 41, wherein the rear drawer panel 42 has a left end and a right end. The drawer 40 may also include a left and right drawer side 43-44 (see FIG. 2). The left drawer side 43 has a proximal end connected to the drawer face's left end and a distal end connected to the rear drawer panel's left end. In similar fashion, the right drawer side 44 has a proximal end connected to the drawer face's right end and a distal end connected to the rear drawer panel's right end. Still further, the drawer 40 includes left and right hinge base rails 45-46 (see FIG. 2 for left hinge base rail 45; right hinge base rail 46 not shown). The left hinge base rail 45 has a proximal end connected to the drawer face 41 approximate the drawer face's left end and a distal end connected to the rear drawer panel 42 approximate the rear drawer panel's left end. The right hinge base rail 46 has a proximal end connected to the drawer face 41 approximate the drawer face's right end and a distal end connected to the rear drawer panel 42 approximate the rear drawer panel's right end.

The drawer 40 also provides left and right support hinges 47-48 (see FIG. 2). Specifically, the left support hinge 47 is connected to the left hinge base rail 45 and the body support frame 30. The right support hinge 48 is connected to the right hinge base rail 46 and the body support frame 30.

A continuous hinge 18 is provided which connects the upper edge of the drawer face 41 and a foot-end edge 31 of the body support frame 30 such that the body support frame 30 rotates about an axis defined by the continuous hinge 18.

Casters or wheels 11 are provided at a lower end of the legs 21-24 to promote mobility of the table 10 along a floor surface. The casters 11 may include a locking mechanism for preventing motion of the table 10 when secured at a desired location.

The invention further includes at least one flexible body holder 50 for supporting the body of the child. The body holder 50 is removably secured to the body support frame 30 and may be formed of mesh or similar flexible material. At least one body restraint 51 may also be provided for retaining the body of the child in a safe manner during feeding.

In the drawings and specification, there have been disclosed typical embodiments of the invention and, although specific terms have been employed, they have been used in a generic and descriptive sense only and not for purposes of limitation, the scope of the invention being set forth in the following claims.

That which is claimed is:

1. A table for supporting the body of a child, comprising:

a substantially rectangular drawer base frame having a left side and a right side;

a plurality of legs fixedly attached to said drawer base frame, each of said legs extending downward from said drawer base frame to support and elevate said drawer base frame above a floor surface;

a left side panel extending across said left side of said drawer base frame and extending upward perpendicularly from said drawer base frame, said left side panel having a vertical interior face generally oriented toward the interior of said drawer base frame;

a right side panel extending across said right side of said drawer base frame and extending upward perpendicularly from said drawer base frame, said right side panel having a vertical interior face generally oriented toward the interior of said drawer base frame;

a single action drawer meaning moveable in a single horizontal direction relative to said drawer base frame, said drawer connected to said drawer base frame at said right side panel and said left side panel of said drawer base frame via a slide mechanism such that said drawer slides in a plane that is substantially parallel to a plane formed by said drawer base frame;

a body support frame for supporting a body of a child, said body support frame adjustably connected to said drawer and having a foot-end and a head-end;

a support hinge for adjusting an angle between (i) the plane in which said drawer slides and (ii) the plane passing through said body support's foot-end and said body support's head-end, thereby adjusting the inclination of the child's body, said support hinge being connected to a front edge of said drawer and said body support frame, said support hinge adjustable along portions of a right side and a left side of said single action drawer;

at least one flexible body holder for supporting the body of the child, said body holder secured to said body support frame; and at least one body restraint for retaining the body of the child;

wherein said single action drawer promotes efficiency by providing a single movement in the plane substantially horizontal to the plane formed by said drawer base frame in a forward and backward movement relative to a user;

wherein said slide mechanism is positioned immediately adjacent to and secured to inner portions of said right side panel and said left side panel thus permitting said drawer and said body support frame to slide in the plane that is substantially parallel to the plane formed by said drawer base frame.

2. The table according to claim 1, further comprising a continuous hinge, wherein:

said drawer has a foot-end edge;

said body support frame has a foot-end edge; and said continuous hinge connects said drawer's foot-end edge and said body support frame's foot-end edge such that said body support frame rotates about an axis defined by said continuous hinge.

3. The table according to claim 1, wherein said slide mechanism comprises:

a left slide mechanism positioned on said left side panel's interior face connecting said drawer to said drawer base frame; and a right slide mechanism positioned on said right side panel's interior face connecting said drawer to said drawer base frame.

4. The table according to claim 1, wherein said drawer comprises:

a drawer face having an upper edge, a left end, and a right end;

a rear drawer panel substantially parallel to said drawer face, said rear drawer panel having a left end and a right end;

a left hinge base rail having a proximal end connected to said drawer face near said drawer face's left end and a distal end connected to said rear drawer panel near said rear drawer panel's left end; and a right hinge base rail having a proximal end connected to said drawer face near said drawer face's right end and a distal end connected to said rear drawer panel near said rear drawer panel's right end;

wherein said left drawer side having a proximal end connected to said drawer face's left end and a distal end connected to said rear drawer panel's left end; and wherein said right drawer side having a proximal end connected to said drawer face's right end and a distal end connected to said rear drawer panel's right end.

5. The table according to claim 4, comprising:

a left support hinge connected to said left hinge base rail and said body support frame; and a right support hinge connected to said right hinge base rail and said body support frame.

6. The table according to claim 4, comprising a continuous hinge, wherein:

said body support frame has a foot-end edge; and said continuous hinge connects said drawer face's upper edge and said body support frame's foot-end edge such that said body support frame rotates about an axis defined by said continuous hinge.

7. The table according to claim 1, comprising a base connecting lower portions of said plurality of legs.

8. The table according to claim 7, said base comprising:

a foot-end base member connecting at least two legs;

a head-end base member connecting at least two legs;

a left side base member connecting at least two legs; and a right side base member connecting at least two legs.

9. The table according to claim 1, further comprising casters connected to a lower end of each of said plurality of legs, said casters promoting mobility of said table along a surface and having a locking mechanism for preventing motion of said table when secured at a desired location.

* * * * *